United States Patent [19]

Hyytinen

[11] 3,938,271

[45] Feb. 17, 1976

[54] EJECTION PORT CLOSURE FOR FIREARMS

[75] Inventor: Timo Hyytinen, Jyvaskyla, Finland

[73] Assignee: Valmet Oy, Finland

[22] Filed: Mar. 29, 1974

[21] Appl. No.: 456,377

[30] Foreign Application Priority Data

Apr. 5, 1973 Finland ..... 1060/73

[52] U.S. Cl. ..... 42/16

[51] Int. Cl.[2] ..... F41C 27/08; F41C 11/00

[58] Field of Search ..... 42/16

[56] References Cited

UNITED STATES PATENTS

| | | | |
|---|---|---|---|
| 1,413,109 | 4/1922 | Feederle | 42/16 |
| 2,484,694 | 10/1949 | Dicke | 42/16 |
| 3,619,926 | 11/1971 | Alday | 42/16 |

FOREIGN PATENTS OR APPLICATIONS

| | | | |
|---|---|---|---|
| 27,821 | 12/1911 | United Kingdom | 42/16 |

*Primary Examiner*—Samuel Feinberg
*Assistant Examiner*—C. T. Jordan
*Attorney, Agent, or Firm*—Harold D. Steinberg

[57] ABSTRACT

A firearm which has a receiver formed with an ejection port through which the cartridge case of a spent cartridge is ejected. A bolt is situated in the receiver for movement between a forward firing position and a rear retracted position, a cartridge case being ejected when the bolt is in its rear retracted position. The bolt is also supported in the receiver for rotary movement between locked and unlocked positions. A sleeve is operatively connected to and surrounds the bolt for rotating the latter between its locked and unlocked positions, this sleeve having a length substantially less than the length of the bolt and covering part of the ejection port when the bolt is in its firing position. A cover is provided to cover that part of the port which is not covered by the sleeve when the bolt is in its firing position, and this cover responds to rearward movement of the bolt from its firing to its retracted position for uncovering the ejection port.

5 Claims, 4 Drawing Figures

EJECTION PORT CLOSURE FOR FIREARMS

BACKGROUND OF THE INVENTION

The present invention relates to firearms.

In particular, the present invention relates to that type of firearm, such as a semi-automatic shotgun, which has a bolt capable of moving axially between a forward firing position and a rear retracted position as well as capable of rotating between locked and unlocked positions. Such a bolt, which forms part of the action of the firearm, is housed within a receiver which is formed with an ejection port through which a cartridge case of a spent cartridge is ejected. The movement of the bolt is brought about at least partially by way of a sleeve which surrounds the bolt, and in addition to its other functions, this sleeve serves to close the ejection port when the bolt is in its forward firing position.

Because the ejection port is relatively long and because it must be covered by this sleeve, the sleeve also is undesirably long, and in addition the receiver must be made of a length sufficiently great to receive the relatively long sleeve when the bolt is retracted in order to uncover the ejection port at least to an extent sufficient to permit the cartridge case to be ejected.

Thus, these factors result in an undesirably long action and receiver.

SUMMARY OF THE INVENTION

It is accordingly a primary object of the present invention to provide for a firearm of the above general type a receiver and action which can be made shorter than has heretofore been possible.

In particular it is an object of the present invention to provide not only a shorter receiver and action but also a construction which at the same time will be capable of effectively covering the ejection port of the receiver when the bolt is in its forward firing position.

In addition it is an object of the present invention to provide a construction of this type capable of being used with a bolt which not only moves longitudinally but which also rotates between locked and unlocked positions.

In addition it is an object of the present invention to provide a construction of the above type which is simple, rugged, and inexpensive so that a reliable operation can be achieved with a construction which will have a long fault-free operating life.

According to the invention the firearm has a receiver means formed with an ejection port through which the cartridge case of a spent cartridge is ejected. An elongated bolt means is situated in the receiver means for longitudinal movement between a forward firing position and a rear retracted position as well as for rotary movement between locked and unlocked positions. A sleeve means, which is considerably shorter than the bolt means, surrounds the bolt means and is operatively connected thereto for turning the bolt means between its locked and unlocked position, this sleeve means serving also to cover part of the ejection port when the bolt means is in its forward firing position. A cover means covers that part of the ejection port which is not covered by the sleeve means when the bolt is in its firing position, and this cover means is operatively connected with at least one of the other means for responding to rearward movement of the bolt means from its forward firing position to its rear retracted position to assume a position uncovering the ejection port when the bolt means is in its retracted position.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
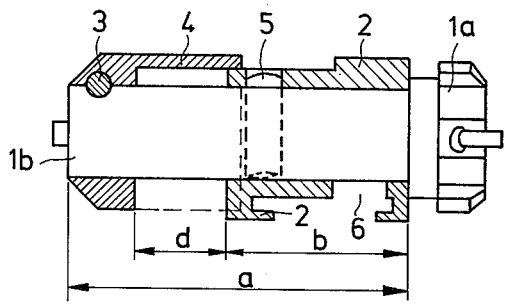
FIG. 1 is a schematic partly sectional longitudinal elevation of part of the action of a firearm provided with the structure of the present invention, the structure being shown in FIG. 1 in the position which it takes when the bolt is in a forward firing position.
Figure 2:
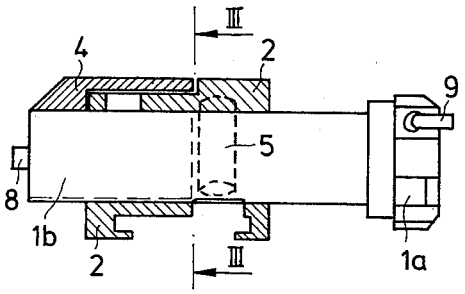
FIG. 2 illustrates in a longitudinal partly sectional elevation the position which the parts of FIG. 1 take when the bolt is retracted.
Figure 3:
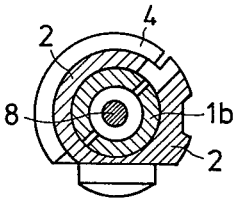
FIG. 3 is a transverse sectional elevation taken along line III—III of FIG. 2 in the direction of the arrows.

Referring first to FIGS. 1–3, there is illustrated therein part of a firearm action having the structure of the present invention. This structure includes the elongated hollow bolt means 1*b* having a front end 1*a* provided in a known way with locking lugs as well as with an extractor hook 9 for engaging the lip at the rear end of a cartridge case or for extending into the canelure at the rear end of the cartridge case for extracting the cartridge case during ejection thereof. A sleeve means 2 surrounds the bolt means 1*b* and is guided by the latter for longitudinal movement. The sleeve means 2 is capable of moving longitudinally but does not turn.

According to one of the features of the present invention the sleeve means 2 is considerably shorter than the bolt means 1*b*. Thus it will be seen from FIG. 1 that the length *b* is much shorter than the length *a* of that part of the bolt means 1*b* which is situated to the rear of the front end 1*a* which has the locking lugs. Thus the dimension *a* is considerably greater than the dimension *b* ($a >> b$).

The sleeve means 2 is formed in a known way with a slot which forms part of a helix and which receives a free end of a pin 5 which is fixed to the bolt means 1*b* and which has a free end extending outwardly beyond the bolt 1*b* into the spiral slot of the sleeve means 2. Thus in response to axial movement of the sleeve means 2 along the bolt means 1*b* the pin 5 will be cammed by the spiral slot of the sleeve means 2 in order to turn the bolt means 1*b* between its locked and unlocked positions, and the length of the sleeve means 2 will be determined by the axial distance through which it must be displaced with respect to the bolt means 1*b* in order to provide the required rotary movement of the bolt means between its locked and unlocked positions, the length of the sleeve means 2 also being determined by the part 6 thereof which is connected to a structure schematically illustrated in FIG. 4. This latter structure connected to the region 6 of the sleeve means 2 cooperates in a known way with a magazine for placing a new cartridge in front of the bolt means after ejection of the case of a spent cartridge.

Figure 4:
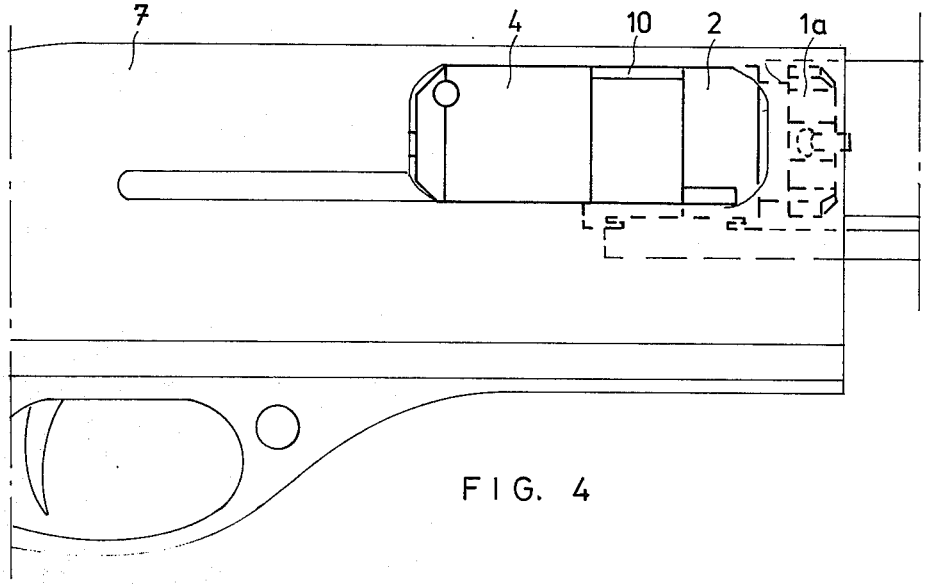
FIG. 4 is a fragmentary schematic illustration of a firearm provided with the structure of the present invention, FIG. 4 showing in particular the receiver and ejection port and the manner in which the parts of FIGS. 1–3 cooperate therewith.

This structure which is shown in FIGS. 1–3 is housed within a receiver 7 illustrated in FIG. 4. The receiver 7 is formed with the elongated ejection port 10 through which the cartridge case of a spent cartridge is ejected in a known way. The parts of FIGS. 1–3 are shown in FIG. 4 in the forward firing position, and it will be noted that in this latter position of the parts the sleeve means 2 serves to cover only the forward portion of the ejection port 10.

FIG. 4 also shows schematically a trigger which releases a hammer which strikes the rear end of a firing pin 8 part of which is apparent in FIGS. 1 and 2, this pin 8 being shown in section in FIG. 3. The transverse pin 5 is formed with a transverse bore through which the firing pin 8 extends.

In order to close or cover that part of the ejection port 10 which is not closed or covered by the sleeve means 2 when the bolt means 1*b* is in its forward firing position shown in FIG. 4, a cover means 4 is provided in accordance with the present invention. Thus, the cover means 4 serves, as shown in FIG. 4, to cover that part of the port 10 which is not covered by the sleeve means 2 when the bolt means is in its firing position. This cover means 4 may be operatively connected to any other one of the means referred to above for responding to retraction of the bolt means 1*b* in order to assume a position uncovering the port 10 so that a cartridge case of a spent cartridge can be ejected.

In the particular example illustrated in the drawings, the cover means 4 has a rear end portion directly fixed to a rear end of the bolt means 1*b* by a pin 3 which may take the form of a suitable dowel or cotter pin. This pin 3 extends transversely with respect to the acis of the bolt means 1*b*. This bolt means 1*b* and the rear end of the cover means 4, which surrounds the rear end of the bolt means 1*b*, are formed with a transverse bore part of which is formed directly in the rear end of the bolt means 1*b* and part of which is formed directly in the cover means 4 so as to provide in this way the opening which receives the fastening pin 3 with the latter extending partly into the bolt means 1*b* and partly into the cover means 4, as shown most clearly in FIG. 1. In this way the cover means 4 is fixed directly to the bolt means 1*b* for movement therewith. The cover means 4 has a wall which extends forwardly from the rear end portion thereof which is fixed directly to the bolt means 1*b* by the pin 3. This forwardly extending wall is spaced from the bolt means 1*b* so as to define with the latter a space for receiving the rear portion of the sleeve means 2. Thus the sleeve means 2 and the cover means 4 cooperate telescopically with each other so as to have in the retracted position of the bolt means shown in FIG. 2 a relationship according to which the sleeve means 2 and cover means 4 overlap each other to an extent greater than in the firing position of the bolt means shown in FIGS. 1 and 4. Thus, the forwardly extending wall of the cover means 4 forms part of a cylinder which extends partly around the rear portion of the sleeve means 2, with the extent of overlap being at a maximum in the position of the parts shown in FIG. 2.

Thus, with the above structure of the invention after a cartridge has been fired, the sleeve 2 is retracted along the bolt means 1*b* from the position of FIG. 1 into the position of FIG. 2, bringing about in this way the rotary movement of the bolt means 1*b* necessary to unlock the latter, and at this time the cover means 4 only turns together with the bolt means 1*b*. After the sleeve means 2 has been moved rearwardly along the bolt means from the position of FIG. 1 to the position of FIG. 2, the entire structure shown in FIG. 2 will move rearwardly so as to uncover the ejection port 10 enabling the cartridge case to be ejected. It will be noted that during retraction of the sleeve means 2 with respect to the bolt means 1*b* the sleeve means 2 moves through the distance *d*, and this distance represents the length which is saved by the present invention. In other words with conventional structures the distance *d* is the distance by which conventional structures must be made longer than the structure of the present invention.

On the other hand, when the bolt means 1*b* is advanced forwardly to its firing position, the cover means 4 moves forwardly with the bolt means and turns therewith while the sleeve means 2 continues to advance forwardly with respect to the bolt means and cover means turning the bolt means so as to lock the bolt means in its firing position. Thus, when the bolt means is in its forward firing position, the ejection port 10 is closed even though the sleeve means 2 has a length which is considerably less than the length of the bolt means.

What is claimed is:

1. In a firearm, receiver means formed with an ejection port through which a cartridge case of a spent cartridge is ejected, elongated bolt means situated in said receiver means for longitudinal movement between a forward firing position and a rear retracted position where said port is uncovered to an extent sufficient for ejection of a cartridge case, said bolt means also being supported in said receiver means for rotary movement between locked and unlocked positions, sleeve means surrounding said bolt means and operatively connected thereto for rotating said bolt means between said locked and unlocked positions thereof in response to longitudinal movement of said sleeve means with respect to said bolt means, said sleeve means having a length substantially shorter than said bolt means and said sleeve means extending across and partially covering said port when said bolt means is in said forward position thereof, said sleeve means moving rearwardly with said bolt means when the latter is displaced from said firing to said retracted position thereof for uncovering said port, and cover means situated in said receiver means for covering that part of said port which is not covered by said sleeve means when said bolt means is in said firing position thereof, said cover means being operatively connected with at least one of the other of said means for responding to movement of said bolt means from said firing to said retracted position to assume a position uncovering said port when said bolt means is in said retracted position thereof, said sleeve means covering a front portion of said port and said cover means covering a rear portion of said port when said bolt means is in said firing position thereof, said cover means being fixed to a rear portion of said bolt means for rotary and longitudinal movement with said bolt means.

2. The combination of claim 1 and wherein a pin extends transversely with respect to said bolt means for fixing said cover means thereto, said bolt means and said cover means being formed with openings which together form a recess for receiving said pin which fixes said cover means to said bolt means.

3. The combination of claim 1 and wherein said cover means and sleeve means cooperate telescopically with said cover means and sleeve means overlapping each other in the retracted position of said bolt means to an extent greater than in the firing position of said bolt means.

4. The combination of claim 3 and wherein said cover means at least partially surrounds said sleeve means at least in the retracted position of said bolt means.

5. The combination of claim 4 and wherein said cover means has a rear end portion fixed directly to said bolt means and has an elongated wall portion extending forwardly from said rear end portion and spaced from said bolt means to define with the latter a space which receives said sleeve means.

* * * * *